US009540142B2

(12) United States Patent
Pirollet

(10) Patent No.: US 9,540,142 B2
(45) Date of Patent: Jan. 10, 2017

(54) DEVICE FOR DISINFECTING OF CLEANING OF A HOUSEHOLD RUBBISH CONTAINER AND THE METHOD FOR DISINFECTING OR CLEANING SUCH A CONTAINER

(75) Inventor: Laurent Pirollet, Roquebrune Cap Martin (FR)

(73) Assignee: Laurent Pirollet, Roquebrune Cap Martin (FR)

( * ) Notice: Subject to any disclaimer, the term of this patent is extended or adjusted under 35 U.S.C. 154(b) by 71 days.

(21) Appl. No.: 14/118,799

(22) PCT Filed: May 14, 2012

(86) PCT No.: PCT/EP2012/058855

§ 371 (c)(1),
(2), (4) Date: Feb. 4, 2014

(87) PCT Pub. No.: WO2012/159907

PCT Pub. Date: Nov. 29, 2012

(65) Prior Publication Data

US 2014/0138267 A1 May 22, 2014

(30) Foreign Application Priority Data

May 20, 2011 (FR) ..... 11 54435

(51) Int. Cl.

| | |
|---|---|
| ***B65D 25/00*** | (2006.01) |
| ***B65D 25/02*** | (2006.01) |
| ***B65F 7/00*** | (2006.01) |
| ***B08B 9/08*** | (2006.01) |

(52) U.S. Cl.
CPC ..... *B65D 25/02* (2013.01); *B08B 9/08* (2013.01); *B65F 7/00* (2013.01)

(58) Field of Classification Search
CPC ..... B65F 7/00; B65F 7/005; B65F 2210/129; B65D 25/00; B65D 83/14
USPC ..... 220/87.2, 87.1, 908.2, 23.89, 502
See application file for complete search history.

(56) References Cited

U.S. PATENT DOCUMENTS

| | | | | |
|---|---|---|---|---|
| 3,636,862 | A * | 1/1972 | Bottas et al. | 100/45 |
| 6,845,888 | B2 * | 1/2005 | Verherbrugghen et al. | 222/162 |
| 7,516,865 | B1 * | 4/2009 | Pierre | 220/87.1 |
| 7,878,359 | B1 * | 2/2011 | Ko | 220/87.2 |
| 2006/0049216 | A1 * | 3/2006 | Bromber | 222/402.13 |
| 2010/0206331 | A1 * | 8/2010 | Shuman et al. | 134/10 |
| 2010/0264168 | A1 | 10/2010 | Larabee | |
| 2011/0116969 | A1 * | 5/2011 | Wallis | 422/28 |
| 2011/0303664 | A1 * | 12/2011 | Nichols | 220/87.2 |
| 2014/0027452 | A1 * | 1/2014 | Pan | 220/87.2 |

FOREIGN PATENT DOCUMENTS

| | | |
|---|---|---|
| GB | 2270262 | 3/1994 |
| GB | 2392621 | 3/2004 |

* cited by examiner

*Primary Examiner* — J. Gregory Pickett
*Assistant Examiner* — Niki M Eloshway
(74) *Attorney, Agent, or Firm* — Hauptman Ham, LLP

(57) ABSTRACT

In at least one embodiment, a container includes an opening for the deposition of rubbish therein and a cleaning or disinfecting device configured to provide a cleaning or disinfecting fluid inside the container. The cleaning or disinfecting device includes a delivery device inside the container configured to deliver a dose of fluid after an inclination of the container and then returning the container to a normal position of use.

12 Claims, 5 Drawing Sheets

DEVICE FOR DISINFECTING OF CLEANING OF A HOUSEHOLD RUBBISH CONTAINER AND THE METHOD FOR DISINFECTING OR CLEANING SUCH A CONTAINER

FIELD

The present disclosure concerns a device for disinfecting or cleaning of a household rubbish container and a method for disinfecting or cleaning such a container.

The present disclosure is applicable to, for example, containers for waste and, in particular, containers of relatively large size used in particular in properties in joint occupation and able to be taken up by rubbish collection vehicles for discharge thereof.

BACKGROUND

Currently, large size containers generally are substantially right-angled parallelepipedal in form and have a lid. The waste is simply introduced into the internal space of the container, which causes problems of cleanliness of these containers. Residual dirt is in particular found in the bottom of the containers due to discharges or refuse sticking to the bottom wall of the container. Inconveniencies relating to odour and cleanliness are thus posed.

The disinfecting of household rubbish containers in some applications is done by an operator manually, after the containers have been emptied of their waste.

This operation is a tedious task for the operator since this requires of him a significant handling of the containers and thereby requires a great deal of time for its execution. It is therefore usual to find that this type of work is not carried routinely after each collection of household rubbish.

The document WO-A-2010/146004 discloses a device for disinfecting a container for the removal of solid waste, said container being provided with a lid that is hinged at the rim of the opening so as to allow at least one rotation between a closed position and an open position obtained by the actuation of a user enabling him to insert bags of waste in the container. The device has at least one receptacle containing a disinfection product that is applied to the internal surface of the wall of the container. The receptacle is provided with at least one pump that emits a spray of said product by pressure applied to the button of said pump. Means are also provided that are connected to the lid of the container and are designed to produce a spray of the disinfectant product when the lid is closed following the actuation thereof by the user after the insertion of a bag of waste.

Though this document presents automatic actuation of the delivery of a cleaning and disinfecting fluid during a movement of opening and closing the lid by a device for dispensing maintenance fluid directly incorporated in the container, it does however have many drawbacks.

In this document, the distribution of fluid takes place at the opening and closing phases of the lid, that is to say very frequently and very often when the container is at least partially filled. Its efficacy is therefore low while using a large quantity of maintenance fluid.

In addition, the fluid-dispensing device is situated at the top part of the container since actuation thereof is linked to the lid. Consequently the dispensing of the fluid, moreover a simple spraying, is not effective for cleaning the bottom of the container, the sprayed fluid generally not arriving as far as the bottom of the container, especially when the latter is filled with refuse.

Finally, the reliability of such a spray system can be called into question.

Another system for delivering a disinfecting liquid is known from US-A-2010264168. This publication shows an actuator resting on the ground outside the container and the piston of which arms a part delivering liquid when the container is lifted. On descent, the piston retracts in contact with ground so as to discharge the liquid. Because of the bearing on the ground, the reliability and mechanical strength of the piston system is more than doubtful. Repeated movements of the container may cause multiple deliveries of liquid when this is not required.

SUMMARY

The problem at the basis of the disclosure is cleaning a household rubbish container effectively without requiring the aid of a cleaning device external to said container.

In some embodiments, there is provided according to the disclosure a rubbish container having an opening for the deposition of rubbish inside it and incorporating a cleaning or disinfecting device configured so as to provide the delivery of a cleaning or disinfecting fluid inside the container. In some embodiments, the cleaning or disinfecting device comprises means for delivering a dose of fluid inside the container configured to deliver the dose of fluid after an inclination of the container and then its return to the normal position of use.

The technical effect obtained is better cleaning or disinfecting of the container. As the spreading of the dose of washing or disinfecting fluid takes place after this discharge when the container is returned to its normal position of use, the container is then emptied of all its rubbish and the washing or disinfecting can take place directly on the bottom of the container. Thus all the fluid combined in a dose is allocated to the cleaning or disinfecting of said container and there is no longer any loss of fluid by contact with rubbish.

In addition, in some embodiments, the quantity of fluid contained by a dose is advantageously substantially always equivalent, which affords economy of fluid, a dose being calculated so as to represent the predetermined quantity necessary and sufficient for effective cleaning or disinfecting.

In some embodiments, the inclination of the container, which consists of a movement comprising a rotation of the container able to modify the angle made by its opening with respect to the horizontal, can be fixed so as to be greater than a threshold value in order to trigger the delivery of the product. In some embodiments, the threshold value can for example be at least 10° or at least 90° (which means that the product is delivered only after a phase of turning the container over).

In some embodiments, at least optionally any one of the following features is implemented:

- the delivery means comprise means for forming a dose of fluid inside the container and means for spreading said fluid in the container, the formation means being active when the container is inclined in the position of discharging the rubbish that it contains and the spreading means being active when the container has been returned to its normal position of use;
- the means for forming a dose of fluid comprise a dosing element filled with a dose of fluid when the container is inclined in the discharge position. The use of a dosing element is a rapid and simple way of creating a dose of cleaning or disinfecting fluid as well as having, at each washing or disinfecting, an equivalent dose of fluid;

the cleaning or disinfecting device comprises a fluid reservoir, the dosing element being connected by a first pipe to said reservoir for taking off a quantity of fluid from said reservoir by gravity when the container is tilted, this quantity forming a dose of fluid, the dosing element also being connected to said reservoir by a second pipe providing an air intake between dosing element and reservoir. Such a use of a dosing element associated with a reservoir makes it possible to achieve the formation of a dose automatically when the container is tilted during unloading thereof, by simple means functioning according to the principle of communicating vessels;

the spreading means comprise a third pipe emerging from the dosing element for discharge of the dose of fluid with a view to spreading thereof in the container, this third pipe being directed towards the bottom part of the container when said container is in its normal position of use. Thus the spreading of the dose of fluid takes place automatically as soon as the container is returned to its normal position of use;

the cleaning or disinfecting device is inserted removably in a housing fixed towards the bottom part of the container when said container is in its normal position of use. This allows the extraction of the cleaning or disinfecting device in particular for filling its reservoir. The housing also has the advantage of protecting the device against miscellaneous dirt;

the housing comprises an orifice for discharging the dose of fluid in the container, this discharge orifice being oriented towards the bottom part of the container when said container is in its normal position of use. Thus the bottom of the container is preferentially treated;

the housing surrounds the cleaning or disinfecting device, the housing comprising a body for receiving said device and a removable lid covering said body. This makes it possible to completely surround the device in order to protect it while making it possible to remove the device easily from the housing in particular for recharging it with fluid;

the body and/or the removable lid does not have any sharp corner externally. Thus there is no risk of bursting bags of rubbish thrown into the container or retaining various elements thrown into the container;

the reception body of the housing is substantially in the form of a parallelepiped with a base and four walls, one of said walls being at least partially in abutment against the inside of the container. This is the form most suited to receiving a reservoir with a substantially similar shape, which is mainly the shape of the reservoir of the washing or disinfecting device;

the discharge orifice of the housing is disposed on the base of the body or on the bottom portion of one of the walls of said body. Thus the bottom of the container is effectively treated. The location of the discharge orifice on the bottom portion of a wall is advantageous because said orifice is liable to be soiled less than when it is disposed directly facing the bottom of the container, an accumulation of rubbish on this orifice then being possible;

the base of the body has a declivity directing the dose of fluid towards said discharge orifice. This allows discharge of all the fluid from the housing and reduces losses of fluid;

the lid has, at its part oriented towards the body, firstly, on one side of said part, at least one tongue entering a recess provided on the reception body and, secondly, on the body opposite said part, a means of locking the lid with respect to said body;

the locking means is composed of a locking lug inserted by pivoting in a locking notch provided in the reception body;

the lid comprises a passage enabling a user to have access to the locking means in order to effect a pivoting of said locking lug.

In at least one embodiment, a cleaning or disinfecting device is in particular suitable for equipping a rubbish container.

In at least one embodiment, it is advantageously on the internal wall of the container body that the device is situated. The latter is thus independent of any lid of the container.

In accordance with another embodiment, a method for cleaning or disinfecting such a household rubbish container is performed by means of a cleaning or disinfecting device internal to the container, this method comprising sequences for delivering a cleaning or disinfecting fluid in the interior of the container, this container being emptied of rubbish that it contains by tilting said container into a discharge position, characterised by the step of forming a dose of fluid inside the container when it is tilted into the rubbish-discharge position and the step of spreading the dose of fluid in the container when the container has been returned to its normal position of use.

In at least one embodiment, the step of forming a dose of fluid and the step of spreading said dose of fluid take place automatically respectively on putting into the discharge position and putting into the normal position of use. Thus making the step of forming a dose dependent on the step of tilting the container for discharging thereof just like the triggering of the step of spreading the dose formed does not require the addition of any particular element, for example a mechanical or electronic element.

BRIEF DESCRIPTION OF THE FIGURES

Other features, aims and advantages of the present disclosure will emerge from a reading of the following detailed description and with regard to the accompanying drawings given by way of non-limitative example and in which.

DETAILED DESCRIPTION

Figure 1:
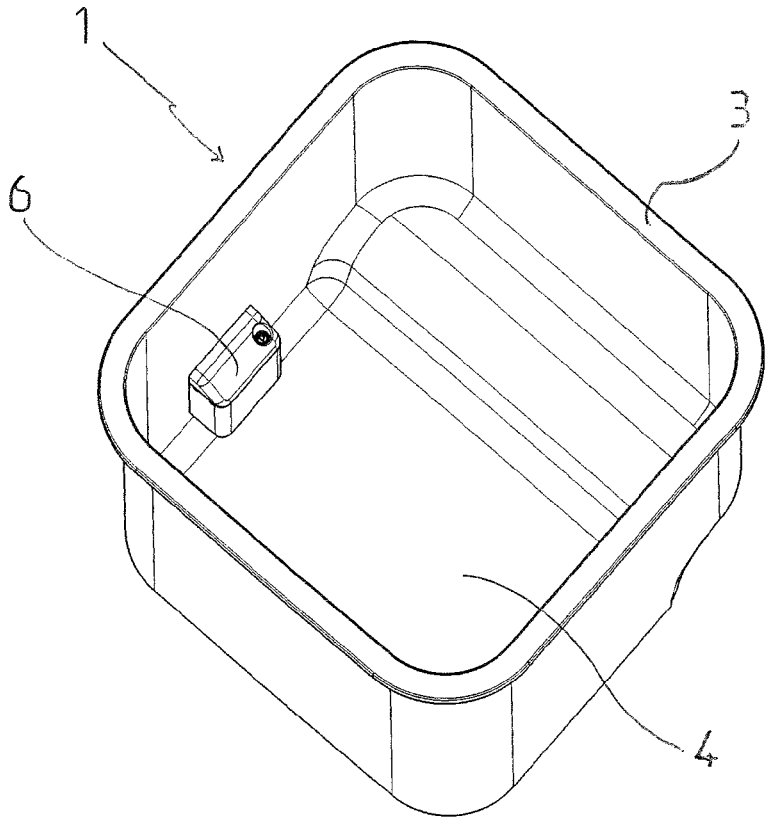
FIG. 1 is a schematic representation of a plan view in perspective of a household rubbish container according to one or more embodiments of the present disclosure showing the interior of said container with the housing for the cleaning or disinfecting device.
Figure 2:
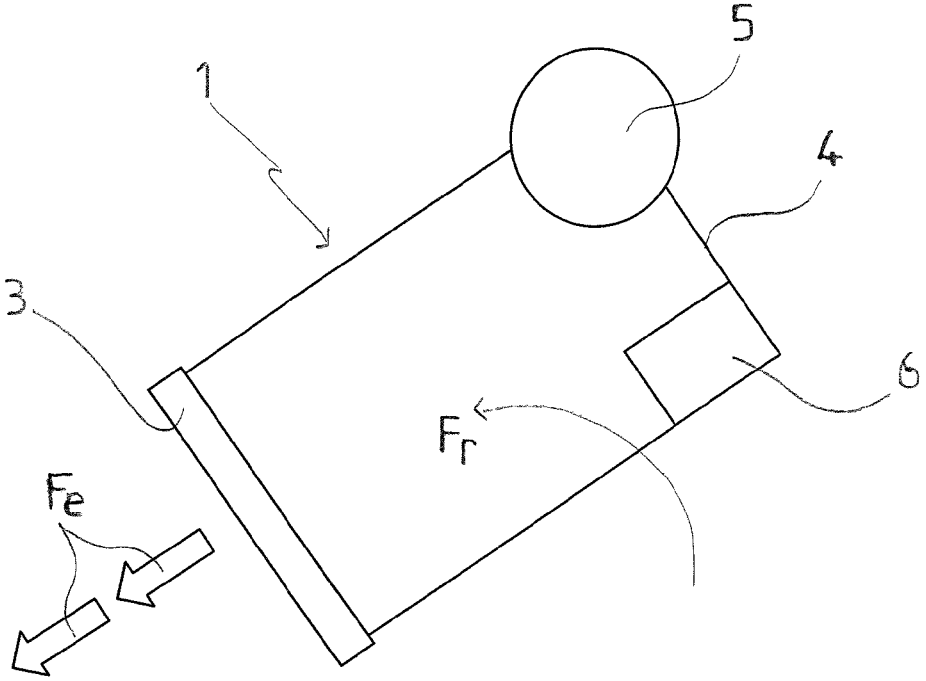
FIG. 2 is a schematic representation of a side view of a household rubbish container according to one or more embodiments of the present disclosure showing in particular the position of the housing for the cleaning or disinfecting device in said container, this container then being in the position for discharging the rubbish that it contains.
Figure 3:
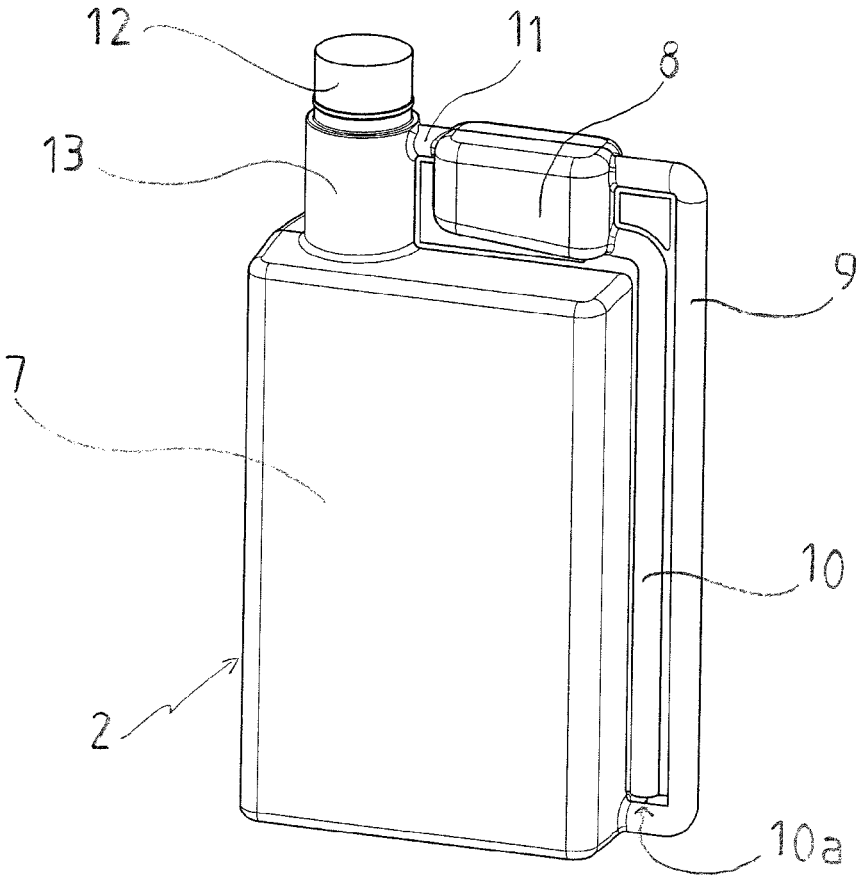
FIG. 3 is a schematic representation of a front view in perspective of a cleaning or disinfecting device intended to be integrated in a household rubbish container according to one or more embodiments of the present disclosure.
Figure 4:
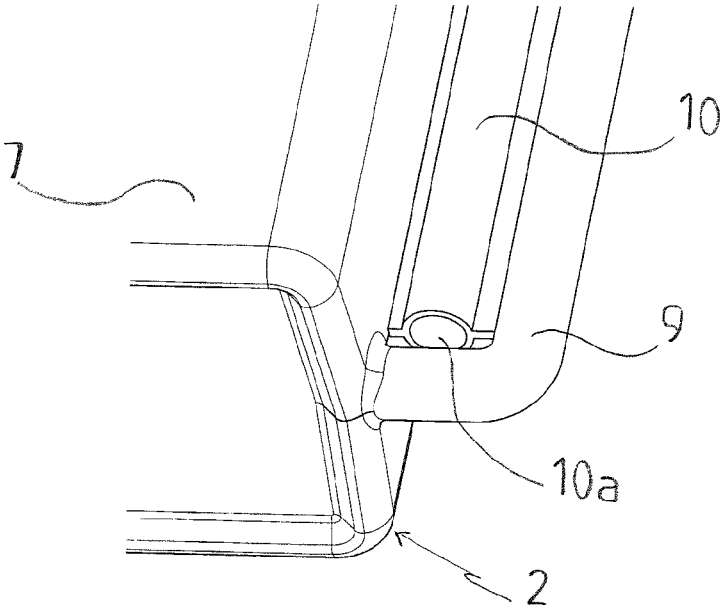
FIG. 4 is a schematic representation of a perspective view from below of part of the cleaning or disinfecting device intended to be integrated in a household rubbish container according to one or more embodiments of the present disclosure, this part being shown enlarged with respect to FIG. 3.
Figure 5:
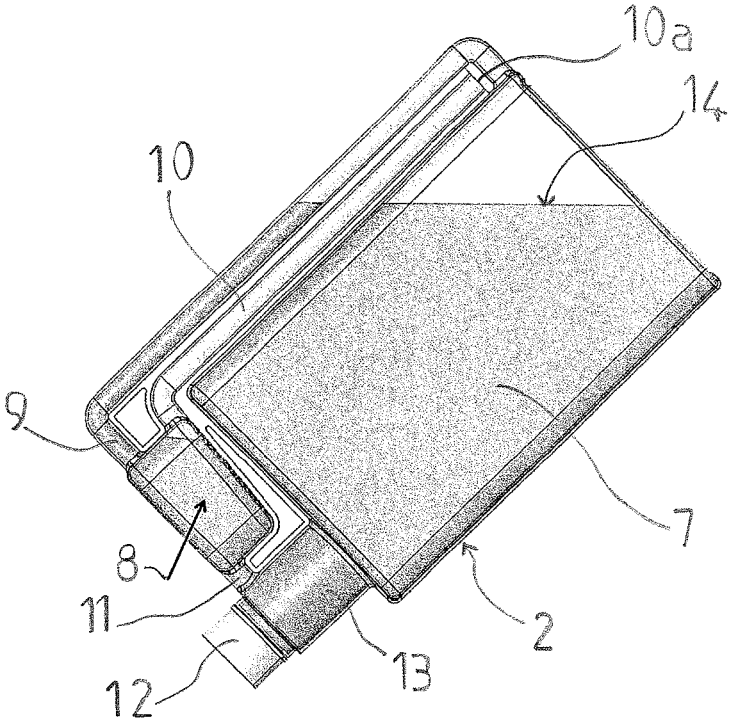
FIG. 5 is a schematic representation of a front view of a cleaning or disinfecting device intended to be integrated in a household rubbish container according to one or more embodiments of the present disclosure, this device being shown in the tilted position in which the dosing element fills.

Referring to FIGS. 1 and 2, the present disclosure concerns a container for the depositing of household rubbish.

Container 1 has a substantially parallelepipedal shape with lateral walls and a bottom 4 delimiting an internal space for receiving rubbish. In its normal position of use, which corresponds to the position of the container 1 for the reception of rubbish, the bottom 4 of the container 1 is close to the ground, the container 1 being movable by means of wheels 5 then resting on the ground. Though FIG. 2 shows a single pair of wheels 5, the container 1 can also be provided with two pairs of wheels 5.

The container 1 has an opening 3 for the depositing of household rubbish in the interior thereof. This opening 3 is situated, in the normal position of use of the container 1 for receiving rubbish, at the top part of the container 1. This opening 3 can be closed by a lid, not shown in the figures, this lid being pivotable between a position of closing the container 1 and the opening position in which the opening 3 is accessible to the users for depositing rubbish or for discharging rubbish that the contain 1 contains.

In accordance with one or more embodiments of the present disclosure, the container 1 incorporates a cleaning or disinfecting device with sequences of delivering a maintenance fluid inside the container 1. This device is shown in FIGS. 1 and 2, being placed inside the housing 6, internal to the container 1. This device and its housing 6 are situated close to the bottom 4 of the container 1 in order to clean said bottom 4 by spreading a cleaning or disinfecting liquid inside the container 1. It is in fact the bottom 4 of the container 1 that is the most liable to be soiled by remains of rubbish not discharged from the container 1 and it is necessary to clean or disinfect this bottom 1 regularly and automatically.

To effect such cleaning or disinfecting, in some embodiments, it is preferably for the container 1 to be previously empty of any rubbish so that the bottom 4 of the container 1 is indeed accessible to the cleaning or disinfecting fluid.

This is one of the features that are proposed by the present disclosure with a cleaning or disinfecting device comprising means for forming a dose of fluid inside the container 1 and means for spreading said fluid in the container 1, the formation means being active when the container 1 is tilted into the position of discharging the rubbish that it contains and the spreading means being active when the container 1 is returned to its normal position of use. Thus the cleaning or disinfecting takes place in a container 1 emptied of its rubbish as soon as the container 1 is returned to the normal position of use.

According to an alternative embodiment, the formation of the dose and the spreading thereof are both consecutive on the return to the normal position, but the tilting and repositioning movement is detected so as to control the delivery of the dose. For example, in some embodiments, a movement sensor system triggers a fluid dispenser (with a pump or the like) after these two movements.

FIG. 2 shows a container 1 in the position of discharging its rubbish. This discharge can take place by pouring the rubbish from the container 1 into a rubbish tipper truck. To do this, the container 1 is subjected to a rotation movement Fr, generally while being connected to the rubbish tipper truck by a device carried by said tipper truck and the rubbish that leaves the container 1 in the direction of discharge of the rubbish Fe falling by gravity into the tipper truck. This operation is also referred to as tipping over the container 1 with a view to discharge thereof.

As shown in FIG. 2, it is not necessary for the container 1 to be completely turned over with its bottom 4 then situated as the top part of the container 1 and the container 1 then extending substantially vertically. In some embodiments, it suffices for the container 1 to be sufficiently tilted for the rubbish to leave the container 1 by gravity and fall outside said container 1.

For an effective cleaning or disinfecting of the bottom 4 of the container, in some embodiments, it is preferable to place the cleaning or disinfecting device close to the bottom. In FIG. 1, the housing 6 receiving the cleaning or disinfecting device is placed on a low portion of a lateral wall of the container 1 close to the bottom, substantially in a middle portion of said lateral wall. In FIG. 2, the housing 6, drawn in broken lines, is situated on a low portion of a lateral wall of the container 1 close to the bottom 4 towards a bottom edge of the lateral wall not carrying a wheel 5.

The positioning of the housing 6 receiving the cleaning or disinfecting device may be any positioning that makes it possible to obtain an action on the bottom 4 of the container 1 effective for spreading concerning in particular a large part of the bottom 4.

The cleaning or disinfecting device will now be described according to one embodiment with regard to FIGS. 3 to 6.

In these figures, the cleaning or disinfecting device 2 has a dosing element 8 filled with a dose of fluid when said container is tilted for discharging the rubbish out of the container, as was shown in FIG. 2. The means for forming a dose of fluid inside the container 1 according to one or more embodiments of the present disclosure comprise this dosing element 8. Thus, during this discharge of rubbish, a predetermined quantity, in some embodiments a sufficient or necessary quantity, for the cleaning or disinfecting of the container 1 is formed by accumulation in the dosing element 8.

The cleaning or disinfecting device 2 comprises a reservoir 7 of cleaning or disinfecting fluid containing sufficient fluid for effecting several doses of fluid. This reservoir 7 comprises a filling plug 12 at its top end in a normal position of use. A neck 13 is provided between the plug 12 and the reservoir 7. The dosing element 8 is disposed substantially above the reservoir 7 when the latter is in the normal position of use, that is to say with its plug 12 pointing upwards. The dosing element 8 is connected by a first pipe 11 to said reservoir 7, by means of its neck 13.

This first pipe 11 serves to take off from the reservoir 7 a quantity of fluid to form a dose of fluid then contained and stored in the dosing element 8. This taking off is effected by gravity when the container is tilted for discharge thereof. To do this, the cleaning or disinfecting device 2 is provided with a second pipe 9 providing an air intake between the dosing element 8 and the reservoir 7. This second pipe 9 extends from the bottom part of the reservoir to the dosing element 8, in some embodiments advantageously emerging in said dosing element 8 on the side opposite to the side on which the first pipe 11 emerges.

The functioning of the cleaning or disinfection device 2 is as follows. It is broken down into a step of forming a dose of fluid in the dosing element 8 when the container is tilted for discharging the waste contained in it and by the spreading of said dose on the bottom of the container when the container is returned to its normal position of use. In some embodiments, this is very advantageous because there is now no or very little rubbish in the container, and cleaning or disinfecting thereof can then take place very effectively, the bottom of the container then being accessible to the cleaning or disinfecting fluid.

When the container is tilted for discharge thereof, the cleaning or disinfecting device 2, which is situated in a housing itself fixed to the container, is tilted accordingly. The cleaning or disinfecting device 2 is thus in the inclined position shown in FIG. 5 with the neck 13 of the reservoir 7 being the lowest part of the device 2. The dosing element 8, which is situated close to the neck 13 of the reservoir 7, then fills with a quantity of cleaning or disinfecting fluid leaving the reservoir 7 through the first pipe 11 between dosing element 8 and reservoir 7.

This quantity is to form a cleaning dose then stored in the dosing element 8. The dose is formed by gravity according to the communicating-vessels principle by means of the second pipe 9 serving as an air intake and connecting the dosing element 8 to the reservoir 7 as previously mentioned. This is because the level of fluid 14 in the reservoir 7 extends substantially horizontally in this tilted position of the device 2 and is on the same horizontal line as the level of fluid in the second pipe 9, which enables the dosing element 8 to be filled.

Figure 6:
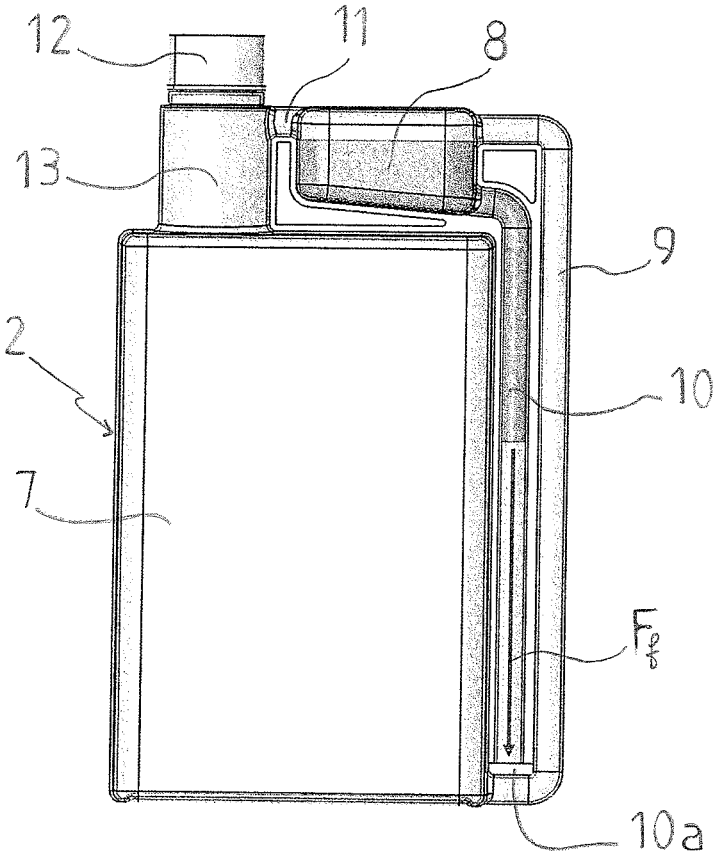
FIG. 6 is a schematic representation of a front view of a cleaning or disinfecting device intended to be integrated in a household rubbish container according to one or more embodiments of the present disclosure, this device being shown returned to its normal position of use, in which position the cleaning or disinfecting fluid is discharged from the dosing element.

The second operating step of the cleaning or disinfecting device 2 is essentially illustrated by FIG. 6. This second step concerns the discharge of the dose of fluid out of the dosing element 8. The dosing element 8 comprises a third pipe 10 for discharge of the dose of fluid with a view to spreading thereof in the container, this third pipe 10 being directed towards the bottom part of the container when said container is in its normal position of use. The means of spreading said fluid in the container according to the present disclosure comprises this third pipe 10. These spreading means are for example supplemented by the means for discharging or directing fluid present in the housing, as will be seen subsequently.

After discharge of the rubbish from the container, during which the filling of the dosing element 8 takes place, the container is returned to the normal position of use and the cleaning or disinfecting device once again occupies a substantially vertical position in its housing in the container, as shown in FIG. 6. The dosing element 8, which is filled with cleaning or disinfecting fluid, is emptied of its fluid through the third discharge pipe 10, said pipe 10 being directed towards the bottom of the device 2 whereas it was directed upwards at the previous step illustrated in FIG. 5.

Thus a method for cleaning or disinfecting a household rubbish container according to one or more embodiments of the present disclosure by the use of a cleaning or disinfecting device 2 internal to the container, this method comprising sequences of delivery of a cleaning or disinfecting fluid inside the container, this container being emptied of the rubbish that it contains by tilting of said container into a discharge position, is characterised by the step of forming a dose of fluid inside the container when it is tilted into the rubbish-discharge position and the step of spreading the dose of fluid in the container when the container has been returned to its normal position of use.

Advantageously, in the method in accordance with one or more embodiments, the step of forming a dose of fluid and the step of spreading said dose of fluid take place automatically respectively during the putting into the discharge position or the putting into the normal position of use. The normal position of use advantageously corresponds to a position in which the bottom of the container 1 is substantially parallel to the ground or to a position where the lateral walls of the container have a substantially vertical principal direction.

The fluid flows into the third discharge pipe 10 in the direction of discharge of the fluid Ff and leaves through the orifice 10*a* terminating the third discharge pipe 10, advantageously close to the connection of the second pipe 9 with the reservoir in some embodiments, but this is not obligatory. Configuration of orifice 10*a* is also particularly clearly visible in FIG. 4.

The features of the housing 6 of the cleaning or disinfecting device will now be explained with regard to FIGS. 7 to 10.

Figure 7:
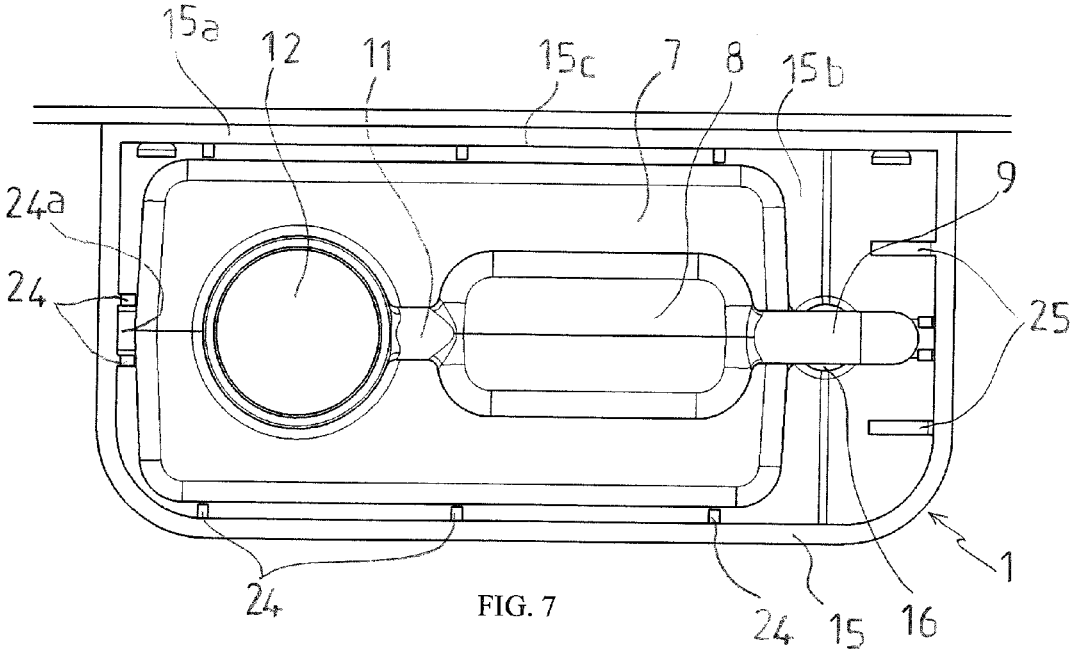
FIG. 7 is a schematic representation of a plan view of a housing integrating a cleaning or disinfecting device for a household rubbish container according the present disclosure.

In FIG. 7, the cleaning or disinfecting device, of which the reservoir 7, the dosing element 8, the first pipe 11, the plug 12 and the second pipe 9 covering the third pipe at a distance can be seen, is removably inserted in a housing 15 fixed towards the bottom part of the container 1 when the latter is in its normal position of use so that the cleaning or disinfecting fluid is spread over the bottom of this container 1. This housing 15 comprises a reception body 15*a* at least partially surrounding the cleaning or disinfecting device. This housing 15 also comprises a removable lid covering said body 15*a*. In FIG. 7 only the reception body 15*a* is visible.

The reception body 15*a* of the housing 15 is substantially in the form of a parallelepiped with a base 15*b* and for lateral faces. One of said lateral faces of the body 15*a* forms a lateral wall 15*c* in abutment against the inside of the container 1, this at least partially. This abutment takes place against a lateral wall of the container 1. If the edges of the lateral wall in abutment 15*c* are straight, the other edges of the lateral walls are rounded so as not to present any sharp corner that could burst plastic bags filled with rubbish introduced into the container 1. The housing 15 has a shape not facilitating the attachment of rubbish on its external part. This will in particular be the case with its lid, as will be described with regard to FIG. 8.

The reception body 15*a* of the housing 15 is adapted to the cleaning or disinfecting device so that the latter occupies substantially all the space inside this body 15*a*. In FIG. 7, the reception body 15*a* has substantially a rectangular cross section with a longitudinal wall of said body 15*a* as the wall 15*c* in abutment against the inside of the container 1. The lateral wall of the reservoir 7 not carrying the second pipe 9 is substantially opposite and at a short distance from a lateral wall of the body 15*a* of the housing 15 while the second pipe 9 is situated opposite and at a short distance from the opposite lateral wall of the body 15*a*. The other front and rear walls of the reservoir 7 are situated opposite and at a short distance from an associated wall of the reception body 15*a*. Thus the cleaning or disinfecting device can move only slightly in the body 15*a* of the housing 15.

To increase the holding of the cleaning of the disinfecting device in the body 15*a*, fixing ribs 24 are provided on the inside of each lateral or longitudinal wall of the body 15*a*, limiting further the movement of the device with respect to the wall of the body 15*a* that carries them.

In at least one embodiment, one of the walls of the cleaning or disinfecting device carries a protrusion 24*a*, for example in the form of suitable to be inserted between two fixing ribs 24 carried internally by a wall of the body 15*a*. In some embodiments, it is preferred that this be the lateral wall of the reservoir 7 opposite to the wall carrying the second pipe 9 that carries this protrusion.

In the normal position of use, the cleaning or disinfecting device is introduced through the top in the body 15*a* of the housing 15, by making said device descend in said body 15*a*. In order to avoid putting the device in an reversed position in the body 15*a* of the housing 15, that is to say a position with a pivoting of 180° of the device about a vertical axis, in at least one embodiment, at least one positive-location rib 25 is provided inside the body 15*a* on at least one of its walls.

Such a positive-location rib 25 extends towards the inside of the body 15*a* and is disposed on the inside of the wall of the body 15 which the lateral wall of the reservoir 7 carrying the second pipe 9 of the device is opposite, this positive-location rib 25 not being facing said pipe but offset with respect to it. This is because empty spaces exist inside the body 15*a* of the housing 15 on each side of the second pipe 9, these spaces being able to receive said rib 25. On the other hand, this positive-location rib forms a stop when the cleaning or disinfecting device is introduced in the reverse position with facing the opposite side of the reservoir 7 not carrying the second pipe 9, such a side not having any empty spaces. Thus the insertion of the device in the reverse position in the reception body 15*a* is made impossible.

The base 15*b* of the reception body 15*a* of the housing 15 comprises an orifice 16 for discharging the dose of fluid into the container 1, and more particularly towards the bottom thereof. In some embodiments, this discharge orifice 16 is therefore oriented towards the bottom part of the container 1 when said container 1 is in its normal position of use. This discharge orifice 16 is situated facing and below the outlet orifice of the third pipe, not visible in FIG. 7 and serving for discharging fluid out of the cleaning or disinfecting device.

In some embodiments, the discharge orifice 16 can also be situated on a lower portion of a wall of the body 15*a* of the housing 15. This is because such a lower portion of a wall of the body 15 is less susceptible to be soiled by deposits of rubbish, which is an obstacle to the spreading of the clearing or disinfecting fluid out of the housing 15.

Figure 8:
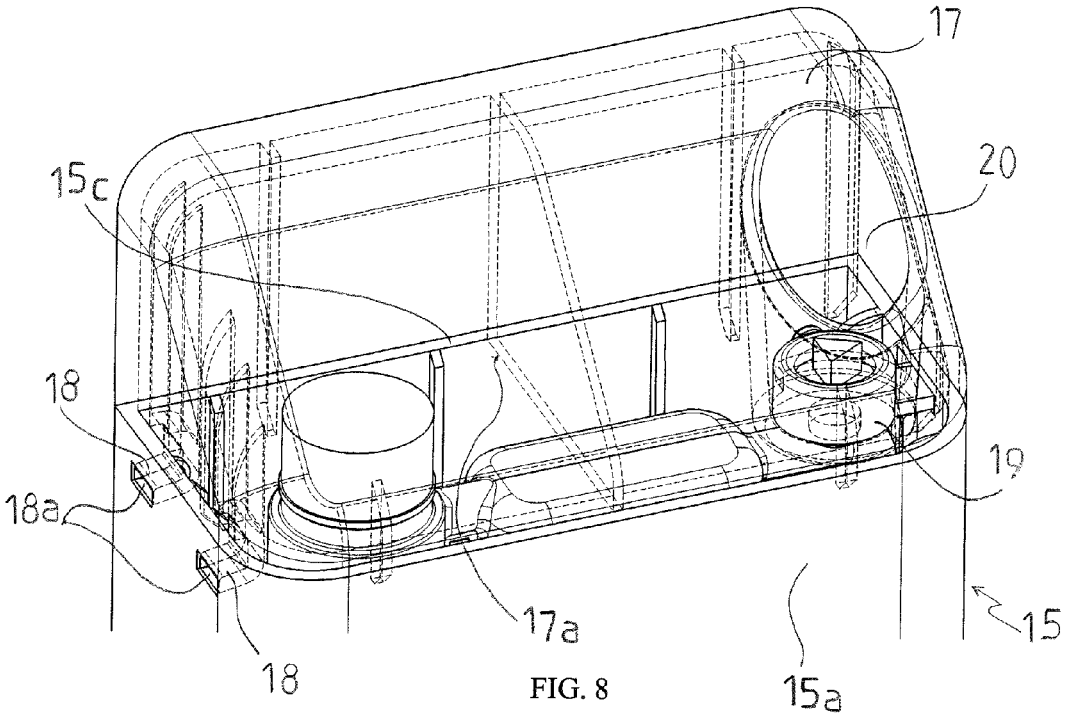
FIG. 8 is a schematic representation of a front view in perspective of the top portion of a housing integrating a cleaning or disinfecting device for a household rubbish container according to one or more embodiments of the present disclosure.

FIG. 8 shows a lid 17 fitting on top of the reception body 15*a* of the housing 15. This lid 17 is advantageously removable so that the cleaning or disinfecting device is removed from the housing 15 in particular to fill the reservoir 7 of this device once again.

In some embodiments, the lid 17 does not have externally any sharp corner for the reasons mentioned above in consideration of the reception body 15*a* of the housing 15. The base of the lid 17 corresponds to the opening at the top part of the body 15*a* while having the same cross section, which has a rectangular cross section in some embodiments.

In FIG. 8, the lid 17 has its highest part in the normal position of use of the container 1 on its wall in abutment against the wall of the container 1, a wall that extends the wall 15*c* of the body 15*a*. In the direction of its width, the lid 17 has an inclined portion 17*a* approaching the body 15*a* and not having externally any sharp corner.

For fixing thereof removably to the reception body 15*a* of the housing 15, the lid 17 has, at its part oriented towards the body, firstly, on one side of said part, at least one lug 18 entering a recess 18*a* provided on the reception body 15*a* and, secondly, on the side opposite said first part, a means 19 for locking the lid 17 with respect to said body 15*a*.

A passage 20 is formed in the inclined portion 17*a* of the lid 17 in order to allow access to the user for locking or unlocking the locking means 19, in particular by means of a suitable tool.

Figure 9:
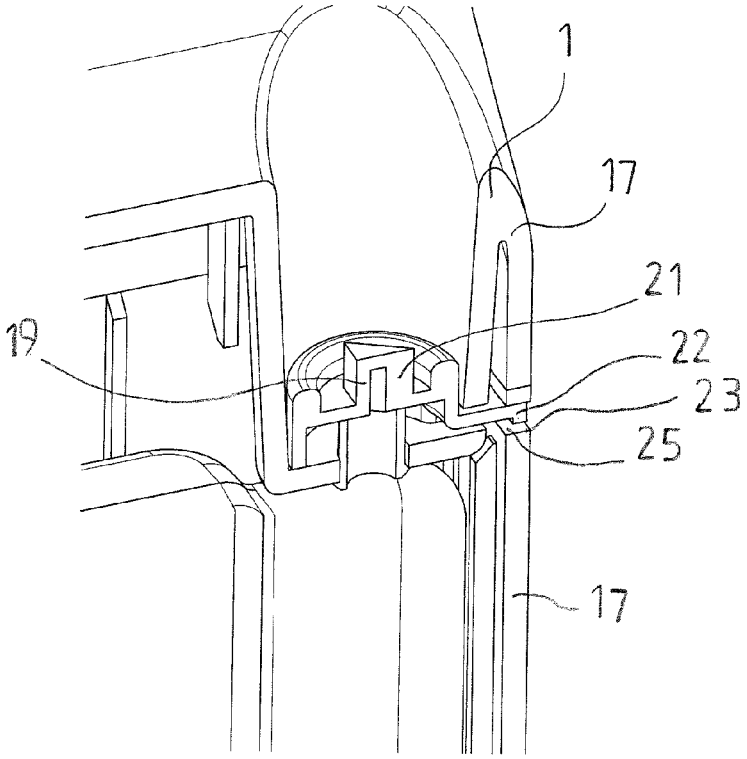
FIG. 9 is a schematic representation of a front view in perspective of the locking means of a housing integrating a cleaning or disinfecting device for a household rubbish container according to one or more embodiments of the present disclosure, this FIG. 9 being enlarged with respect to FIG. 8, the locking means being shown in section.

This locking means 19 is particularly clearly visible in FIG. 9. In this figure, the locking means 19 is composed of a locking lug 22 that can be introduced into a locking notch 23 present in the facing part of the reception body 15*a* when said lug is pivoted and, in some embodiments, in a plane parallel to the plane of the top opening of the reception body 15*a*. The pivoting is effected by the user by action of a means actuated by said user on a head 21 carried by the locking means 19, this head extending along the pivot axis of the lug 22. For example, without this being limitative, the head 21 may be in the form of a triangle or a square and actuated by a corresponding tool.

Figure 10:
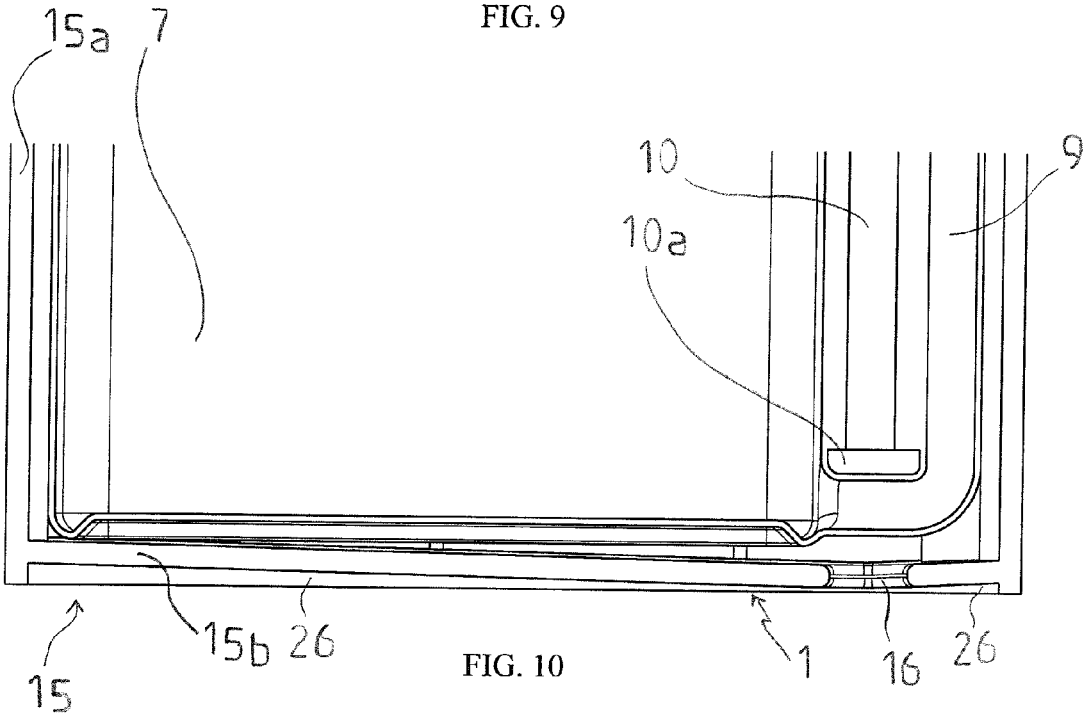
FIG. 10 is a schematic representation of a front view of the bottom portion of a housing integrating a cleaning or disinfecting device for a household rubbish container according to one or more embodiments of the present disclosure, the orifice for spreading the cleaning or disinfecting fluid in the container being in particular visible in this figure, this FIG. 10 being enlarged with respect to FIG. 8.

FIG. 10 shows the lower portion of a housing integrating a cleaning or disinfecting device for a household rubbish container according to the present disclosure.

In this figure there is visible the orifice 10*a* of the third pipe 10 discharging fluid from the reservoir 7 after a quantity of cleaning or disinfecting fluid has previously been dosed in the dosing element. This orifice 10*a* is substantially above a curved connecting part connecting the second pipe 9 to the lower part of the reservoir 7. The reception body 15*a* of the housing 15 has, on its base 15*b*, a discharge orifice 16 for spreading cleaning or disinfecting fluid in the container and in particular on the bottom thereof.

In FIG. 10, the discharge orifice 16 is situated directly below the orifice 10*a* of the third pipe 10. Thus the cleaning or disinfecting fluid can flow more or less directly from the third pipe 10 to the container. In some embodiments, a certain quantity of fluid is able to flow inside the reception body 15*a* of the housing 15 and in particular on its base 15*b*, and it is thus preferably to provide a declivity on this base 15*b*, directing the dose of fluid spread towards said orifice 16. This is obtained by slopes at the bottom 26 on each side of the discharge orifice 16 of the housing 15, the inclination of which is oriented towards the discharge orifice 16, these slopes at the bottom 26 conducting the fluid towards the orifice 16. Thus all the fluid of a dose spread in the housing 15 is discharged from the housing 15 into the container.

Outside the housing 15, close to the discharge orifice 16, there may be an auxiliary device for enabling the fluid to be spread over the entire surface of the bottom of the container but this is not at all obligatory. For example, this device may be composed of a tube having multiple perforations through which the fluid flows towards the bottom of the container.

The invention is not limited to the embodiments described but extends to any embodiment in accordance with its spirit.

The invention claimed is:

1. A container (1) comprising:

walls delimiting an internal space;

an opening (3) configured for the deposition of rubbish therein; and a cleaning or disinfecting device (2) in a fixed position within the internal space and configured to provide a cleaning or disinfecting fluid inside the container (1), wherein the cleaning or disinfecting device (2) comprises a delivery device configured to deliver a dose of fluid in a gravity-based response to an inclination of the container (1) and then returning the container to a normal position of use, the delivery device comprises (8) a dose formation unit for forming the dose of fluid inside the container (1) and a fluid delivery unit (10) for spreading said dose of fluid in the container (1), the (8) dose formation unit configured to be active when the container (1) is inclined in the position of discharging the rubbish contained in the container and the (10) fluid delivery unit configured to be active when the container is returned to the normal position of use, the dose formation unit comprises a dosing element (8) configured to be filled with the dose of fluid when the container (1) is inclined in the discharge position, and the cleaning or disinfecting device (2) comprises a fluid reservoir (7), the dosing element (8) being connected by a first pipe (11) to said reservoir (7) for taking off a quantity of fluid from said reservoir (7) by gravity when the container (1) is inclined, said quantity forming a dose of fluid, the dosing element (8) also being connected to said reservoir (7) by a second pipe (9) providing an air intake between the dosing element (8) and the reservoir (7).

2. The container (1) according to claim 1, wherein the fluid delivery unit comprises a third pipe emerging from the dosing element (8) arranged for discharge of the dose of fluid with a view to spreading thereof in the container (1), the third pipe being directed towards a bottom part of the container when said container (1) is in the normal position of use.

3. The container (1) according to claim 1, wherein the cleaning or disinfecting device (2) is removably positioned in a housing (15) fixed towards a bottom part of the container (1) when said container (1) is in the normal position of use.

4. The container (1) according to claim 3, wherein the housing (15) comprises an orifice (16) for discharging the dose of fluid in the container (1), the orifice (16) being oriented towards the bottom part of the container (1) when said container (1) is in its normal position of use.

5. The container (1) according to claim 4, wherein the housing (15) surrounds the cleaning or disinfecting device (2), the housing (15) comprising a body (15*a*) for receiving said device (2) and a removable lid (17) covering said body (15*a*).

6. The container (1) according to claim 5, wherein the body (15*a*) and/or the removable lid (17) does not have any sharp corner externally.

7. The container (1) according to claim 6, wherein the lid (17) has, at a part of the lid oriented towards the body (15*a*), on one side of said part, at least one tongue (18) entering a recess (18*a*) provided on the body (15*a*) and, on the body opposite said part, an element (19) for locking the lid (17) with respect to said body (15*a*).

8. The container (1) according to claim 7, wherein the element for locking (19) comprises a locking lug (22) configured to be inserted by pivoting in a locking notch (23) provided in the body (15*a*).

9. The container (1) according to claim 8, wherein the lid (17) comprises a passage (20) configured for access to the element for locking (19) in order to effect a pivoting of said locking lug (22).

10. The container (1) according to claim 5, wherein the body (15*a*) of the housing (15) is substantially in the form of a parallelepiped with a base (15*b*) and four housing walls, one of said housing walls being at least partially in abutment against an inside of the container.

11. The container (1) according to claim 10, wherein the discharge orifice (16) of the housing (15) is disposed on a base (15*b*) of the body (15*a*) or on a bottom portion of one of the housing walls of said body (15*a*).

12. The container (1) according to claim 11, wherein the base (15*b*) of the body (15*a*) has a declivity configured to direct the dose of fluid towards said discharge orifice (16).

* * * * *